United States Patent [19]

Kawakami et al.

[11] 4,139,181

[45] Feb. 13, 1979

[54] APPARATUS FOR PREPARING METALLIC MAGNESIUM

[75] Inventors: Noboru Kawakami, Tokyo; Takeji Goto, Atsugi; Itsuo Hirano, Sagamihara; Yoichi Itakura, Musashino, all of Japan

[73] Assignee: Toyo Soda Manufacturing Co., Ltd., Tamaguchi, Japan

[21] Appl. No.: 828,203

[22] Filed: Aug. 26, 1977

[30] Foreign Application Priority Data

Sep. 24, 1976 [JP] Japan ..... 51-113721

[51] Int. Cl.[2] ..... C22B 45/00

[52] U.S. Cl. ..... 266/148; 75/67 R

[58] Field of Search ..... 13/8; 75/10 R, 10 A, 75/67 R, 67 A; 266/148

[56] References Cited

U.S. PATENT DOCUMENTS

| | | | |
|---|---|---|---|
| 35,276 | 5/1862 | Fleury et al. | 266/148 |
| 1,311,379 | 7/1919 | Bleecker et al. | 13/8 |
| 1,884,993 | 10/1932 | Hansgirg | 75/10 A |
| 2,018,265 | 10/1935 | Kemmer | 75/67 R |
| 2,109,841 | 3/1938 | Hansgirg | 75/67 R |
| 3,151,977 | 10/1964 | Ritter et al. | 75/67 R |
| 3,761,248 | 9/1973 | Avery | 75/67 R |

*Primary Examiner*—Gerald A. Dost

*Attorney, Agent, or Firm*—Oblon, Fisher, Spivak, McClelland & Maier

[57] ABSTRACT

Metallic magnesium is prepared by reducing magnesium oxide with carbon and condensing metallic magnesium by ejecting a coolant gas from a nozzle having small hole to an outlet opening for discharging the mixed gas of the coolant gas, carbon monoxide and metallic magnesium, which is disposed at the corresponding position to the nozzle.

5 Claims, 3 Drawing Figures

APPARATUS FOR PREPARING METALLIC MAGNESIUM

BACKGROUND OF THE INVENTION

1. Field of the Invention

The present invention relates to a method of preparing metallic magnesium(hereinafter referring to as Mg) and an apparatus for preparing the same.

More particularly, the present invention relates to a method of preparing Mg from magnesium oxide by reducing it with carbon and the apparatus therefor.

2. Description of Prior Arts

It has been known that deriving Mg from magnesium oxide by reducing it with carbon is the most effective method because the by-product of the slug is smaller than with other methods and the method is economically advantageous.

The reaction of magnesium oxide with carbon is as follows.

$$\underset{\text{solid}}{MgO} + \underset{\text{solid}}{C} \rightleftharpoons \underset{\text{gas}}{CO} + \underset{\text{gas}}{Mg}$$

The reaction is reversely performed at temperatures higher than 400°C. but below about 1850° C. That is, the reaction is performed from left to right at higher than about 1,850° C. to give the Mg a partial pressure of higher than 1 atm.

The reaction is performed right to left at lower than 1850° C. In order to increase the yield of Mg, the reaction mixture of the mixed gas of Mg and CO is cooled to the temperature for inhibiting the reverse reaction. That is, it is necessary to rapidly cool the reaction mixture of the mixed gas below 400° C. A coolant gas is usually used for the rapid cooling step. The coolant gas can be hydrogen, helium, nitrogen or a hydrocarbon gas such as methane.

Various attempts have been made to achieve a rapid cooling method and the apparatus therefor, such as a method of contacting the resulting mixed gas of Mg and CO with a water cooled plate so as to cool the mixed gas (U.S. Pat. No. 2,018,265), or a method of cooling the resulting mixed gas by ejecting a coolant gas from the center of a water cooling jacket formed at the outlet of the reactor as shown in FIG. 2 (U.S. Pat. No. 1,884,993).

However, the reverse reaction could not be satisfactorily prevented by these methods. In the latter method, a scale may be deposited around the outlet. These conventional methods have been unsatisfactory.

SUMMARY OF THE INVENTION

It is an object of the present invention to provide a method of preparing metallic magnesium in which the reverse reaction of magnesium with carbon monoxide is substantially prevented.

It is another object of the present invention to provide a method of preparing metallic magnesium without depositing a scale.

The foregoing and other objects of the present invention have been attained by preparing metallic magnesium from magnesium oxide by use of a carbon reducing method including ejecting a coolant gas from a nozzle having small hole to an outlet opening for discharging the mixed gas of the coolant gas, carbon monoxide and metallic magnesium so as to cause suction effect.

DETAILED DESCRIPTION OF THE PREFERRED EMBODIMENTS

Figure 1:
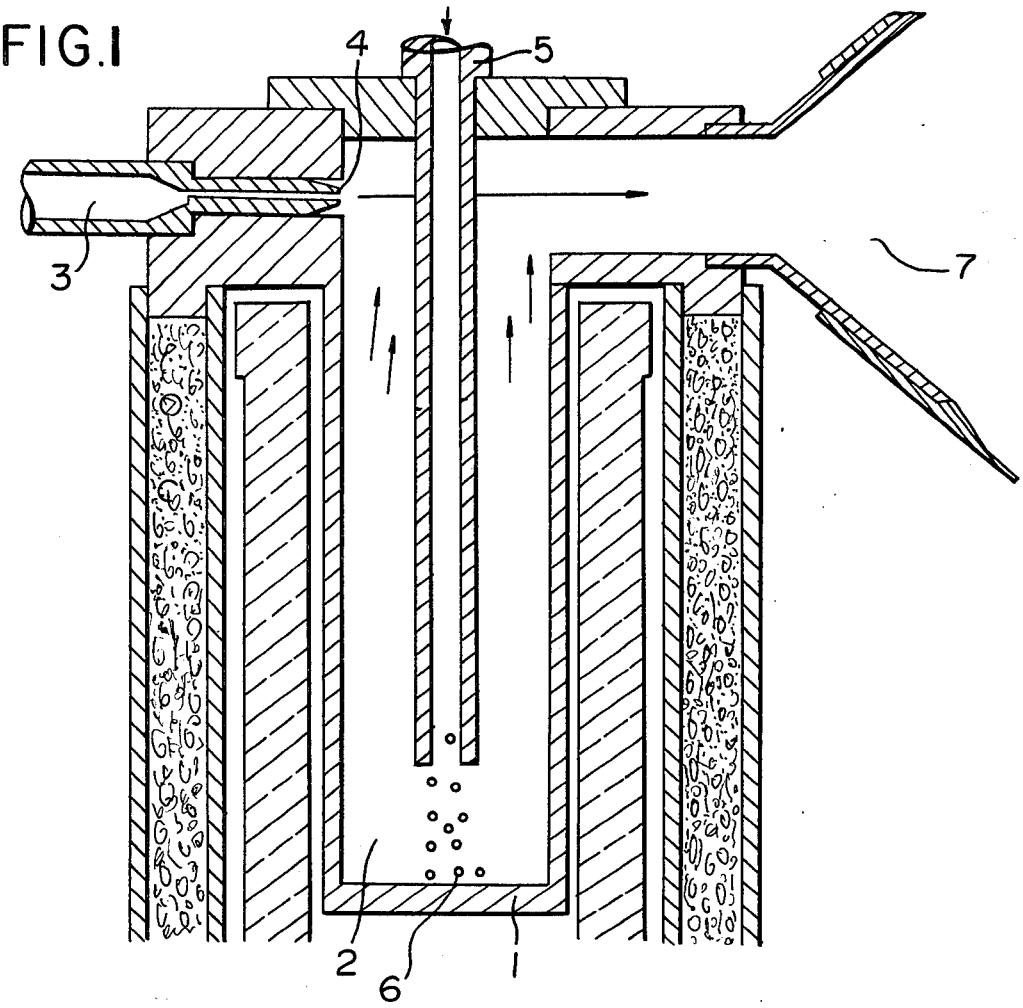
FIG. 1 is a sectional view of one embodiment of the reactor for preparing Mg according to the present invention.

In FIG. 1, the reactor comprises a furnace 1, a reaction chamber 2, coolant gas pipe 3, a nozzle 4 for ejecting the coolant gas which is utilized in the invention, a raw material feeding tube 5, a raw material 6 in the reaction chamber, and a reaction mixture outlet opening 7.

Figure 3:
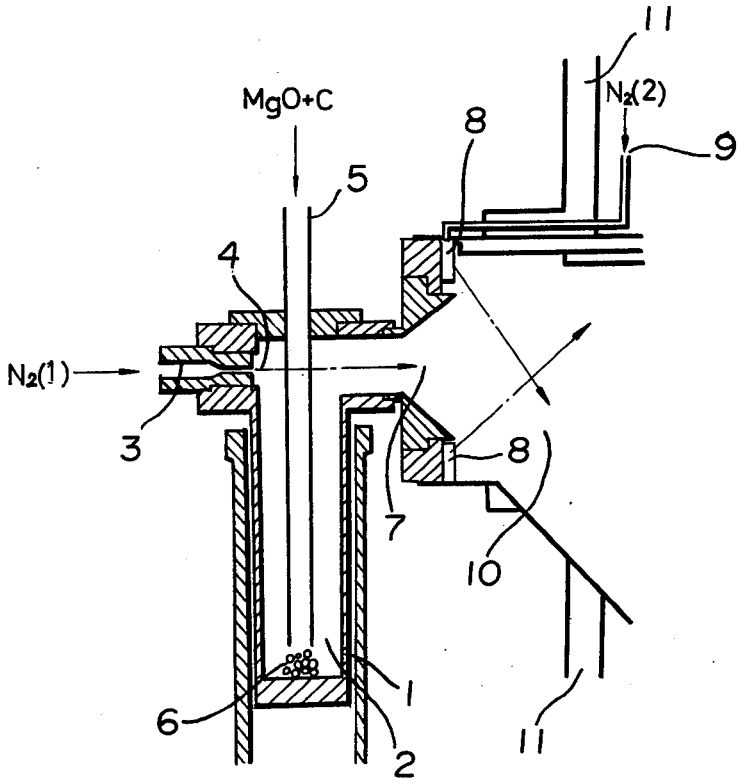
FIG. 3 is a sectional view of a second embodiment of the reactor for preparing Mg according to the present invention.

In FIG. 3, the outlet opening 7 is connected to a cooling chamber which has holes for ejecting the secondary coolant gas 8, a pipe for the secondary coolant gas 9, cooling chamber 10, water cooling jacket 11, and furnace 1.

The raw materials, magnesium oxide and carbon, are blended at suitable ratio and the mixture is preferably granulated to have suitable size which is charged through the raw material feeding tube 5. It is preferable to dispose the raw material feeding tube 5 so as to be out of the coolant gas flow in the reaction chamber from the viewpoint of cooling effect.

The raw material feeding system is preferably sealed with an inert gas, preferably the inert gas being the same as the coolant gas. The raw material can be continuously fed into the reaction chamber.

The raw material fed into the reaction chamber 2 is heated by the furnace 1 to generate Mg gas and CO gas. The reaction chamber is made of a substrate which is durable at high temperature such as carbon material.

In the method of rapidly cooling the reaction gas according to the present invention, high pressure coolant gas is ejected from the coolant gas nozzle 4 disposed at the upper part of the reaction chamber and the coolant gas is passed in jet flow through the upper part of the reaction chamber, whereby the mixture of Mg gas and CO gas is forcibly sucked so as to flow to the outlet opening which leads to a cooling chamber, and the rapid cooling and the mixing with the inert gas are attained.

At the coolant gas feeding elements, the ratio of the inner diameter of the coolant gas pipe 3 to the inner diameter of the nozzle 4 is larger then 1 and a taper is formed for the merger of the inner diameter of the coolant gas pipe 3 and the nozzle. The ejector effect can be attained by ejecting the coolant gas through such a nozzle having a small hole since the ejected coolant gas flows directly to the outlet opening having a diameter larger than that of the nozzle.

It is preferable to decrease the inner diameter of the nozzle so as to eject the coolant gas at higher velocity. The coolant gas velocity is dependent upon the inner diameter of the nozzle when total feeding rate of the coolant gas is constant. In this case, when the ratio of the inner diameter of the coolant feeding pipe to that of the nozzle is increased, the suction effect is increased. When the tip of the nozzle is near the coolant feeding pipe, the pressure loss is small whereby the suction effect is also increased.

The most important feature of the ejection of the coolant gas is to cause the coolant gas stream to flow directly to the outlet opening so as to result lower pressure at the upper part of the reaction chamber, whereby Mg gas and CO gas are easily entrained into the coolant gas stream at the upper part of the reaction chamber and the Mg gas and CO gas are rapidly cooled in the coolant gas.

It is necessary to cool the reaction mixture from the reaction temperature to lower than 400° C. at high cooling velocity for 1/100 to 1/5000 seconds.

The rate of the coolant gas is preferably more than 20 times that of the reaction gas. The linear ejection velocity of the coolant gas at the tip of the nozzle into the reaction chamber is preferably 200 to 700 m/sec. preferably 300 to 550 m/sec.

When the linear velocity is 200 to 700 m/sec., the total pressure in the reaction chamber is lower than 1 atm. (about 50–100 ($mmH_2O$)).

When the linear velocity of the coolant gas is too high, the flow of the coolant gas is spread whereby too much of the coolant gas is contacted on the wall around the outlet opening 7. Accordingly, the suction effect of the coolant gas on the reaction gas is lowered. Moreover, the wall of the reaction chamber around the nozzle is unsufficiently cooled so that the temperature of the reaction gas is raised by the heated wall thereby decreasing the rapid cooling effect.

The raw material feeding velocity and the inner diameter of the nozzle are dependent upon linear velocity and the amount of the coolant gas.

The nozzle is made of a substrate which is durable at high temperature such as carbon material.

The position of the nozzle for ejecting coolant gas is at a relatively upper part of the reaction chamber and is facing the outlet opening through the center of the reaction chamber.

A ratio (D/d) of the inner diameter (D) of the outlet opening to the inner diameter (d) of the nozzle 4 is preferably higher than 30.

The tip of the nozzle can from the wall surface of the reaction chamber. However, it is preferable to dispose the tip of the nozzle at or within the surface of the reaction chamber from the viewpoint of scale depositing and the cooling effect.

The coolant gas can be inert gas such as hydrogen, argon, helium and nitrogen gas, or a hydrocarbon gas such as methane gas.

The coolant gas can be recycled. Although the recycled gas contains a small amount of carbon monoxide, it can be reused. The temperature from coolant gas is in a range of the room temperature to 200° C.

When a secondary cooling gas is fed into the cooling chamber, the reaction mixture can be effectively cooled. The secondary coolant gas is ejected around the outlet opening 7 in the cooling chamber 10. The type of inlet used for the secondary coolant gas is not confined to a single type and can be a nozzle or a pipe etc. The reaction mixture is collected and purified by distillation.

In accordance with the present invention, the inner diameter of the nozzle is small, and the ejector effect is attained by ejecting the coolant gas into the reaction chamber, whereby the pressure in the reaction chamber is reduced. Accordingly, the raw material can be smoothly fed and the partial pressure of the resulting Mg gas is reduced and the reaction is performed at lower temperature and the retaining of the reaction gas in the reaction chamber can be prevented.

The suction of the coolant gas on the reaction gas is higher than those of the other methods and the reaction gas is smoothly discharged under suction from the reaction chamber and the reaction gas is well mixed with the coolant gas to result in a high cooling effect and preventing the disadvantageous reverse reaction.

EXAMPLE 1

In the reactor shown in FIG. 1, the reaction chamber 2 made of carbon material had a cylindrical shape having an inner diameter of 70 mm, and a height of 260 mm. The raw material feeding tube 5 was disposed at the place near the peripheral wall. The coolant gas pipe 3 having an inner diameter of 10 mm and the nozzle having an inner diameter of 1.4 mm and made of carbon material were disposed at the upper part of the reaction chamber in a direction perpendicular to the center line of the cylindrical reaction chamber so as to face the outlet opening 7. The carbon resistant furnace 1 was formed around the reaction chamber 2. The distance between the top of the nozzle 4 and the coolant gas pipe 3 was 73 mm.

Magnesium oxide (MgO) was mixed with oil coke (200 mesh under) at equal molar ratio, 3% aqueous solution of polyvinyl alcohol was added, and the mixture was granulated to form granules having a diameter of 0.5 to 1 mm. The granules were completely dried to remove water. The dried granules were fed from the hopper sealed with nitrogen gas by a quantitative feeder.

The reaction temperature was 1,900° C., the raw material feeding velocity was 2 g/min., and the coolant gas of nitrogen was ejected at a linear velocity of 373 m/sec.

After the reaction for 10 hours, the reaction mixture collected by a collector disposed behind the outlet opening 7 was analyzed to find the components shown in Table 1.

Figure 2:
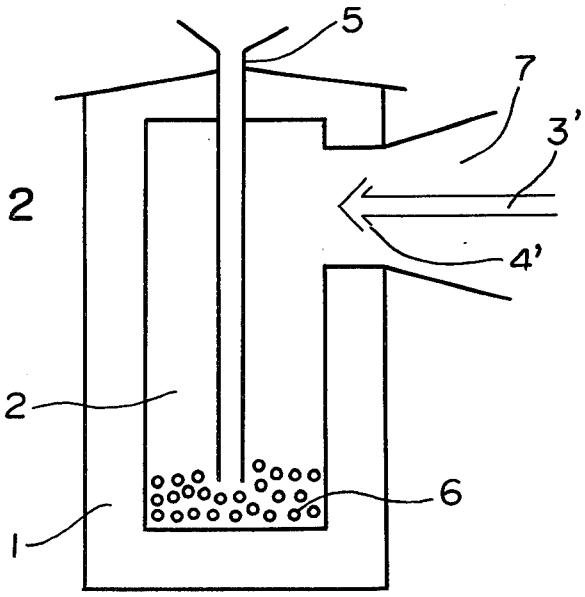
FIG. 2 is a schematic view of the conventional reactor for preparing Mg.

As a reference, the process of Example was repeated except using the conventional reactor shown in FIG. 2 wherein the coolant gas was fed through a coolant gas pipe having four nozzles (diameter of 0.7 mm) in a direction 45 degrees from the radial direction reaction chamber. The rate of the coolant gas was the same as that of the Example.

As a result, the scale was deposited around the outlet opening after 35 min. from the initiation of the reaction and the passage was clogged whereby the reaction could not continued. The reaction mixture collected by the collector was analyzed to find the components shown in Table 1.

Table 1

| | (wt. %) | | |
|---|---|---|---|
| | Total Mg | C | N |
| Example 1 | 89.0 | 3.3 | 0.5 |
| Reference | 78.2 | 5.6 | 0.5 |

The reaction mixture was distilled in vacuum to obtain Mg and the residue was analyzed. The nitrogen content was found to be magnesium nitride.

The results are shown in Table 2.

Table 2

| | (wt. %) | | | | |
|---|---|---|---|---|---|
| | Mg | MgO | C | Magnesium carbide | Magnesium nitride |
| Example | 81.1 | 13.2–12.6 | 2.9–2.5 | 1–2 | 1.8 |
| Reference | 72.0 | 20.0–18.8 | 5.2–4.4 | 1–3 | 1.8 |

EXAMPLE 2

The reaction chamber of Example 1 was connected to a cooling chamber equipped with secondary coolant gas inlets as shown in FIG. 3.

The process of Example 1 was duplicated in Example 2 except feeding of the raw material was at a rate of 2.6 g/min., and ejecting of the cooling gas nitrogen was at a linear velocity of 359 m/sec. into the reaction chamber at a reaction temperature of 1,900° C.

The secondary nitrogen cooling gas was ejected at a rate of 255 m/sec. through four nozzles (inner diameter of 0.5 mm) disposed around the outlet opening to the cooling chamber. The reaction was continued for 30 hours. The reaction mixture collected by the collector was analyzed and the components found are shown in Table 3.

Table 3

| | (wt. %) | | |
|---|---|---|---|
| | Total Mg | C | N |
| Example 2 | 89.7 | 3.1 | 0.5 |

The reaction mixture was distilled as in the process of Example 1. The components obtained the distillation are shown in Table 4.

Table 4

| | (wt.%) | | | | |
|---|---|---|---|---|---|
| | Mg | MgO | C | Magnesium carbide | Magnesium nitride |
| Example 2 | 84.1 | 10.4–9.9 | 2.7–2.2 | 1–2 | 1.8 |

What is claimed is:

1. In an apparatus for preparing metallic magnesium in a reaction chamber by reducing magnesium oxide with carbon and rapidly cooling the reaction mixture, an improvement which comprises a cooling gas pipe; a nozzle, connected to said cooling gas pipe and facing into an upper part of said reaction chamber, having an inner diameter smaller than an inner diameter of said cooling gas pipe; and an outlet opening aligned with said nozzle at an upper part of the reaction chamber opposite said nozzle, whereby the coolant is ejected from said nozzle at a high velocity to suck the reaction mixture from said reaction chamber through said outlet opening without substantially impinging upon the reaction chamber wall.

2. An apparatus according to claim 1 which further comprises a cooling chamber connected to said outlet opening of said reaction chamber and at least one secondary coolant gas inlet disposed around said outlet opening in said cooling chamber.

3. An apparatus according to claim 1 wherein a feeding tube for feeding magnesium oxide and carbon extends into the reaction chamber near one wall of said reaction chamber out of the path of alignment of said outlet opening and said nozzle, whereby the flow of coolant gas is not disturbed by the tube.

4. An apparatus for preparing metallic magnesium by reducing magnesium oxide with carbon and rapidly cooling the reaction mixture, said apparatus comprising a reaction chamber having a top, a bottom, and vertical walls; a cooling chamber having an inlet; a relatively large outlet opening located in an upper vertical wall portion of the reaction chamber and connected to the inlet of the cooling chamber; a nozzle having an inner diameter located within an upper vertical wall portion of said reaction chamber opposite said outlet opening and pointed towards said outlet opening; a coolant gas pipe having an inner diameter larger than the inner diameter of said nozzle and attached to said nozzle for ejecting coolant gas at a high velocity from said nozzle towards said outlet opening at 200 to 700 m/sec. whereby said coolant gas passes through said opening without substantially impinging upon a wall defining said relatively large outlet opening thereby creating a suction effect which sucks the reaction mixture out of the reaction chamber; a cooling jacket communicating with said cooling chamber; and at least one secondary coolant gas inlet disposed in said cooling chamber around said outlet opening whereby the reaction mixture is rapidly cooled.

5. Apparatus according to claim 4 wherein a vertical material feeding tube extends to near the bottom of the reaction chamber adjacent one vertical wall of said reaction chamber and out of the flow path of said coolant gas.

* * * * *